US006305786B1

(12) United States Patent
Plotkin et al.

(10) Patent No.: US 6,305,786 B1
(45) Date of Patent: Oct. 23, 2001

(54) UNIT PRINT HEAD ASSEMBLY FOR AN INK-JET PRINTER

(75) Inventors: Lawrence R. Plotkin; Bruce Cowger; Donald B. Ouchida; Robert R. Beeson, all of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 08/200,719

(22) Filed: Feb. 23, 1994

(51) Int. Cl.[7] ..... B41J 2/14; B41J 2/16
(52) U.S. Cl. ..... 347/50
(58) Field of Search ..... 347/49, 50, 87, 347/86, 85; 439/660

(56) References Cited

U.S. PATENT DOCUMENTS

| | | | | |
|---|---|---|---|---|
| 3,366,915 | * | 1/1968 | Miller . | |
| 3,989,131 | | 11/1976 | Knirsch et al. | 197/1 R |
| 4,350,448 | | 9/1982 | Hanagata et al. | 400/120 |
| 4,368,478 | | 1/1983 | Koto . | |
| 4,394,669 | | 7/1983 | Ozawa et al. . | |
| 4,433,341 | | 2/1984 | Thomas . | |
| 4,462,037 | | 7/1984 | Bangs et al. . | |
| 4,475,116 | | 10/1984 | Sicking et al. . | |
| 4,496,959 | * | 1/1985 | Frerichs | 347/86 |
| 4,500,895 | | 2/1985 | Buck et al. . | |
| 4,510,510 | | 4/1985 | Terasawa . | |
| 4,530,611 | * | 7/1985 | Borcerk | 347/86 X |
| 4,576,496 | | 3/1986 | Schwarz et al. | 400/352 |
| 4,577,200 | | 3/1986 | Rix et al. . | |
| 4,614,948 | | 9/1986 | Katerberg et al. . | |
| 4,620,202 | | 10/1986 | Koto et al. . | |
| 4,628,332 | | 12/1986 | Matsumoto . | |
| 4,633,274 | | 12/1986 | Matsuda . | |
| 4,635,073 | | 1/1987 | Hanson . | |
| 4,658,272 | * | 4/1987 | Toganoh | 347/89 X |
| 4,680,859 | | 7/1987 | Johnson . | |
| 4,683,481 | | 7/1987 | Johnson . | |
| 4,694,308 | | 9/1987 | Chan et al. . | |
| 4,746,935 | | 5/1988 | Allen . | |
| 4,771,295 | | 9/1988 | Baker et al. . | |
| 4,791,438 | | 12/1988 | Hanson et al. . | |
| 4,806,106 | | 2/1989 | Mebane et al. . | |
| 4,814,786 | | 3/1989 | Hoisington et al. . | |
| 4,847,630 | | 7/1989 | Bhaskar et al. . | |
| 4,847,631 | * | 7/1989 | Naruse et al. | 347/49 |
| 4,872,026 | | 10/1989 | Rasmussen et al. . | |
| 4,872,027 | | 10/1989 | Buskirk et al. . | |
| 4,917,286 | | 4/1990 | Pollacek . | |
| 4,920,360 | * | 4/1990 | Terasawa et al. | 347/49 |
| 4,929,969 | | 5/1990 | Morris . | |
| 4,940,413 | | 7/1990 | Childers et al. . | |
| 4,940,998 | * | 7/1990 | Asakawa | 347/37 |
| 4,953,287 | | 9/1990 | West et al. . | |
| 5,016,023 | | 5/1991 | Chan et al. . | |
| 5,049,904 | | 9/1991 | Nakamura et al. . | |
| 5,138,342 | * | 8/1992 | Kurata et al. | 347/50 |
| 5,148,185 | * | 9/1992 | Abe et al. | 347/65 |
| 5,155,502 | * | 10/1992 | Kimura | 347/86 X |
| 5,194,015 | | 3/1993 | Yamamoto et al. | 439/484 |
| 5,224,866 | * | 7/1993 | Nakamura | 439/81 |
| 5,291,226 | * | 3/1994 | Schantz | 347/47 X |
| 5,442,386 | * | 8/1995 | Childers | 347/50 |
| 5,477,963 | * | 12/1995 | Mochizuki et al. | 206/701 |

FOREIGN PATENT DOCUMENTS

| | | | |
|---|---|---|---|
| 0 376 719 A3 | 7/1990 | (EP) . | |
| 418817A1 | 9/1990 | (EP) | B41J/2/005 |
| 492955A2 | 12/1991 | (EP) | B41J/25/34 |
| 581297A2 | 7/1993 | (EP) | B41J/25/34 |

OTHER PUBLICATIONS

"Printhead Interconnect," R. T. Buck; HP Journal, May 1985.

* cited by examiner

*Primary Examiner*—John Barlow
*Assistant Examiner*—Michael S. Brooke

(57) ABSTRACT

A print head assembly that is removably mounted to a carriage. The print head assembly fits within a socket defined by the carriage. Exposed electrical leads in the socket and the print head assembly body are brought into contact when the assembly is inserted into the carriage socket.

20 Claims, 4 Drawing Sheets

UNIT PRINT HEAD ASSEMBLY FOR AN INK-JET PRINTER

TECHNICAL FIELD

This invention pertains to ink-jet printing, and in particular to modular construction of ink-jet printing pens whereby a print head assembly is manufactured as a unit and thereafter removably mounted to the pen body.

BACKGROUND AND SUMMARY OF THE INVENTION

Some ink-jet printers, such as manufactured by Hewlett-Packard Company under the designation DeskJet, include a cartridge or "pen" that is mounted to the printer. The pen includes a body that defines a reservoir of ink, and a print head that is operated for ejecting minute ink drops onto paper that is advanced through the printer.

Prior ink-jet pens have been constructed so that the print head is irremovably attached to the pen body, thereby preventing replacement of a print head without damage to the pen.

The present invention is directed to a construction whereby ink-jet printer pens have modular or unit print head assemblies that can be readily mounted to and removed from a pen body or carriage in the event that the assembly needs repair or replacement. Moreover, the print heads of an individual unit print head assembly may be fully tested before that assembly is joined with several other parts in constructing a pen.

Also provided is a mechanism for ensuring that the electrical connection between the assembly and carriage is sealed from exposure to liquids such as ink.

DETAILED DESCRIPTION OF PREFERRED EMBODIMENTS

Figure 1:
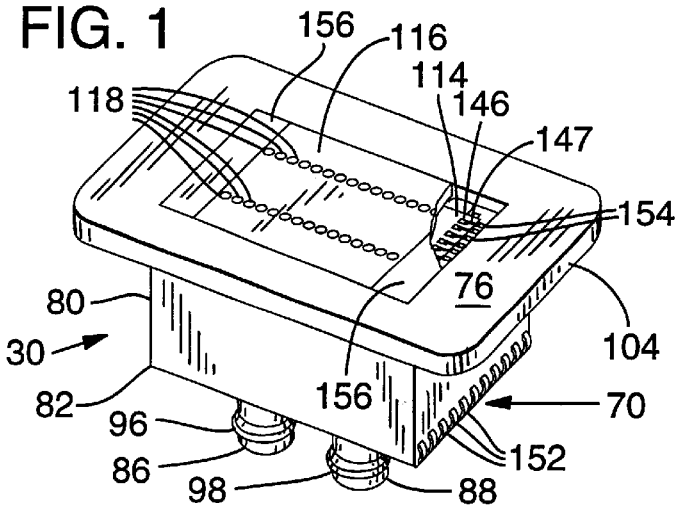
FIG. 1 is an isometric view of a print head assembly made in accordance with the present invention.
Figure 2:
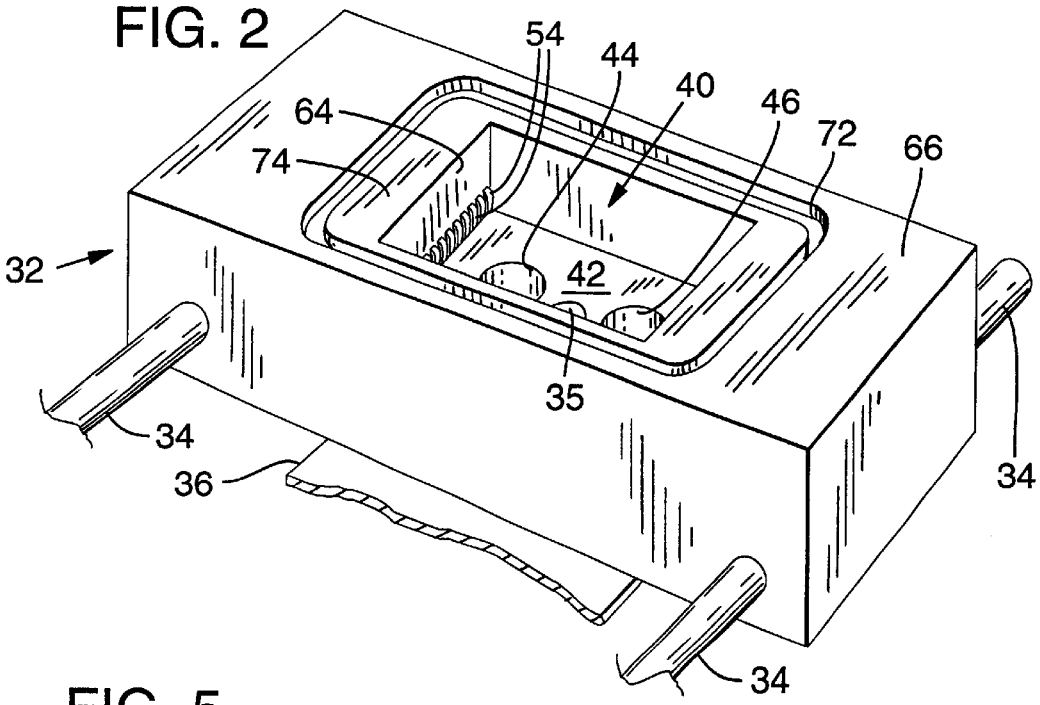
FIG. 2 is an isometric view of a carriage, made in accordance with the present invention, for supporting the print head assembly during printing.

The present invention includes a print head assembly 30 that is removably mounted to a carriage 32. The carriage is mounted to slide along a pair of guide rods 34 in the printer and is driven by known means (such as, by an attached, motor-driven endless belt) to scan back and forth immediately adjacent to a sheet of paper that is advanced through the printer. Control signals from the printer microprocessor are conducted to the carriage by a flexible, ribbon-type multi-conductor 36. When the print head assembly 30 is mounted to the carriage 32, associated electrical leads on those parts connect for conveying the electrical signals from the conductor 36 to the print head assembly so that the print head 114 that is attached to the assembly 30 may be actuated to eject ink drops.

Figure 3:
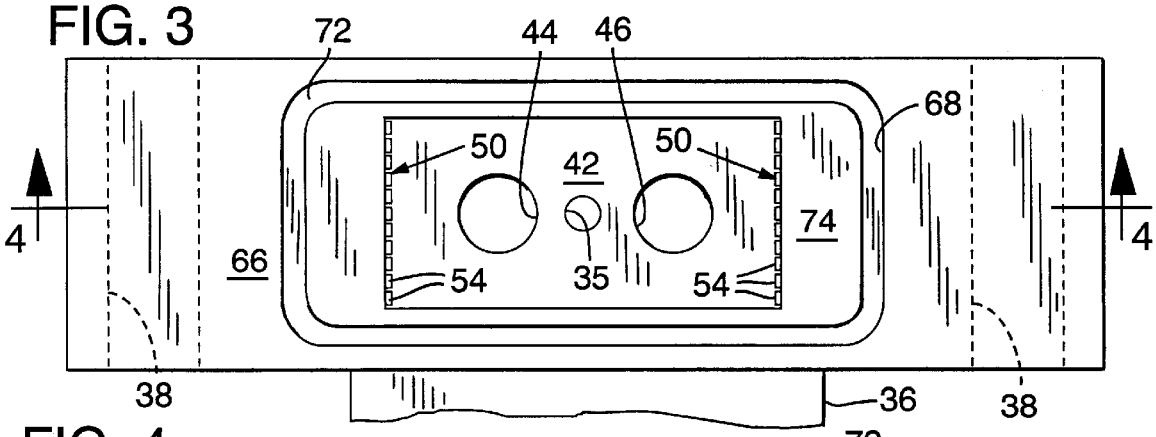
FIG. 3 is a top plan view of the carriage.
Figure 4:
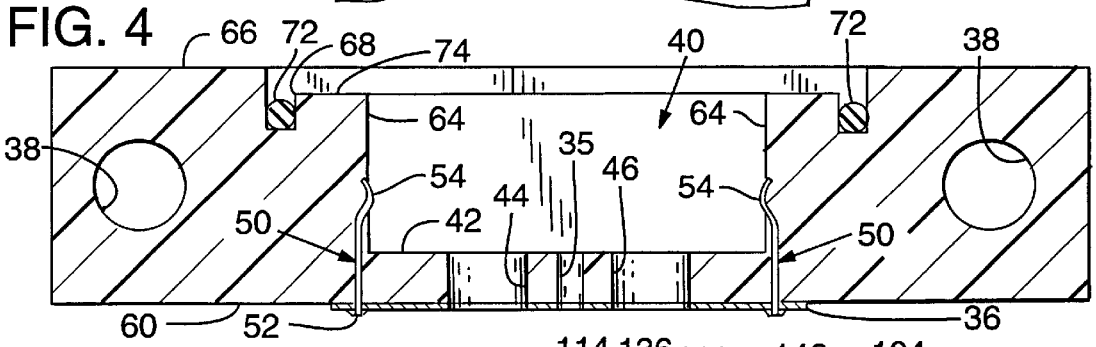
FIG. 4 is a cross-sectional view of the carriage taken along line 4—4 of FIG. 3.

Turning now to the particulars of the carriage 32, that component may be made of any rigid light-weight material, such as polysulfone. In one preferred embodiment, the carriage is oblong shaped in plan view (FIG. 3). At each end, the carriage includes through holes 38, through which fit the guide rods 34 of the printer. A socket 40 is formed in the center of the carriage 32. The otherwise flat bottom surface 42 of the socket is interrupted with an inlet hole 44 and an adjacent outlet hole 46. The holes 44, 46 permit the print head assembly to connect with an ink supply system as described below.

The carriage is constructed with a plurality of metallic leads 50 embedded therein. The leads conduct control signals from the multi-conductor 36 to the print head assembly 30. More particularly, each lead 50 has a pin end 52 that protrudes from the bottom surface 60 of the carriage 32. Each pin end 52 is connected, such as by welding, to the terminus of one of the copper conductors 62 that are carried by the multi-conductor 36. The conductors 62 carry the print head control signals generated by the printer microprocessor. Preferably, the flexible multi-conductor 36 is heat-staked or otherwise bonded to the bottom surface 60 of the carriage. The multi-conductor is arranged in the printer to bend as necessary as the carriage is reciprocated across the width of the printer.

The leads 50 extend from the multi-conductor 36 through the carriage 32 and have bowed ends 54 that protrude into the socket 40 at opposing end walls 64 of the socket. Preferably, the leads are of sufficient thickness and width at their bowed ends 54 to normally resist deformation out of the bowed configuration, thereby to provide a secure, snap-fit with corresponding leads 70 on the print head assembly 30, as described below.

As will become clear upon reading this description, it is desirable to ensure that the vicinity where the carrier leads 50 and print head leads 70 engage is sealed against the ingress of ink or other liquid. To this end, the carriage top surface 66 is formed with a peripheral groove 68 that surrounds the socket 40, and into which groove is fastened an elastomeric O-ring 72. The O-ring 72 provides the just-mentioned sealing function, as will become clear later.

Between the groove 68 and socket 40, the carriage top surface defines a recessed portion 74, thereby to permit the print head assembly 30 to fit into the socket in a manner such that the top surface 76 of the print head assembly is substantially co-planar with the top surface 66 of the carriage.

Turning now to the particulars of a print head assembly 30 formed in accordance with the present invention, and as best shown in FIGS. 1 and 6–9, the print head assembly 30 includes a rigid plastic body 80 having a base 82 that generally conforms in shape to the socket 40 in the carriage 32.

The underside 84 of the base is formed to include a rigid, protruding inlet pipe 86 and a similarly shaped outlet pipe 88. The bore of the inlet pipe 86 defines part of an inlet conduit 90 that extends through the base 82 of the print head body for delivering ink to the print head as described below. Similarly, the bore of the outlet pipe 88 defines an outlet conduit 92 that extends through the base of the print head body for conducting ink that is supplied to the print head, but not ejected therefrom, back to the ink supply.

Preferably, the inlet pipe 86 is covered with a fine-mesh screen 94 to restrict the entry of air and foreign matter into the print head. The ends of both the inlet pipe 86 and outlet pipe 88 are formed to include annular ribs for supporting an O-ring 96 to provide a tight, liquid-sealing fit inside of a resilient inlet tube 98 and outlet tube 100, respectively.

The inlet tube 98 conducts ink from the supply 197 (FIG. 10), the outlet tube 100 returns ink to the supply. Preferably, the ends of the inlet tube 98 and outlet tube 100 are fastened to the carriage 32, such as shown at 102 (FIG. 6), by a bead of adhesive. Attaching the tubes to the carriage permits the pipes 86, 88 to be easily inserted into and removed from the tubes as the print head assembly 30 is mounted to and removed from the carriage 32. For simplicity, the tubes 98, 100 are not shown in FIGS. 1–4. Moreover, as explained below, the carriage (hence, the print head assembly) may be supplied with ink without the use of such tubes.

A flanged part 104 (FIG. 1) of the print head assembly base 82 protrudes from the top of the base to extend over the recessed portion 74 of the carriage surface 66. Above the recessed portion 74, the flanged part 104 has a thickness that substantially matches the depth of the recess that defines the surface portion 74. The portion of the flanged part 104 that extends over the groove 68 has an integrally formed, downwardly protruding lip 106 (FIG. 6) that, when the print head 30 is mounted to the carriage 32, fits into the groove 68 to compress the O-ring 72. As a result, any liquid that may enter the small gap 108 between the top surface 76 of the print head assembly and the top surface 66 of the carriage will be prevented from moving into the carriage socket 40 (hence, into the region where the leads 50, 70 engage).

Figure 5:
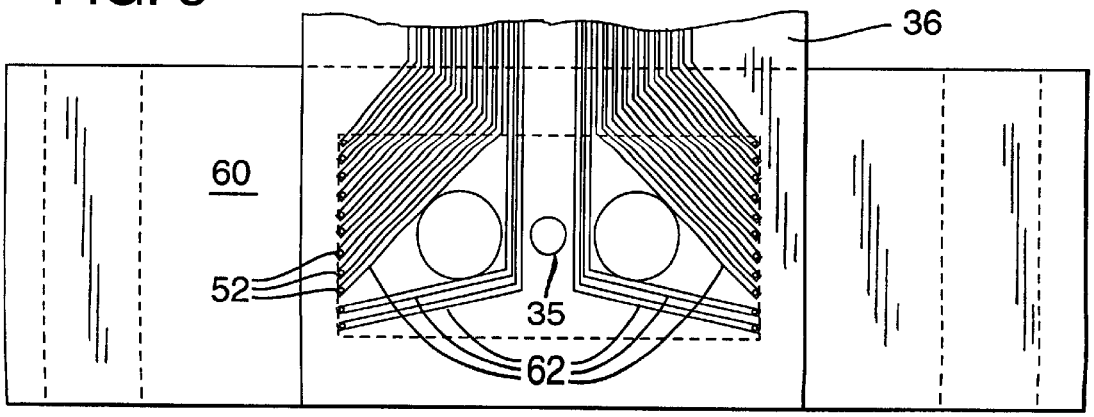
FIG. 5 is a bottom view of the carriage.

It will be appreciated that the O-ring 72 could be elsewhere located. For example, the O-ring could be located on the underside of the flanged part 104 of the print head base, or on the recessed portion 74 of the carriage top surface, to be compressed between the flanged part and that surface. In such an alternative, the recessed portion 74 would be recessed somewhat further than shown in FIG. 5, and the lip 106 would extend to fit snugly within the groove 86.

Figure 6:
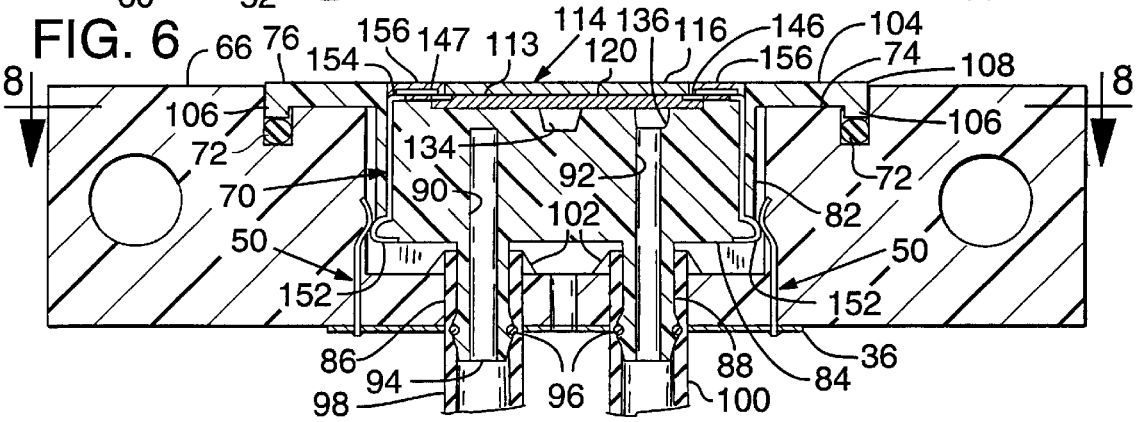
FIG. 6 is a cross-sectional view of the carriage taken along line 4—4 of FIG. 3 and including the print head assembly mounted to the carriage.

A generally oblong recess 112 (FIG. 8) is formed in the top of the print head body 80. The print head 114 generally comprises a base part 120 and covering orifice plate 116 (FIG. 6). The base part 120 generally corresponds to the shape of the recess 112 and is mounted therein, such as by bonding with adhesives. The metallic or plastic orifice plate 116 covers the base part 120 and is slightly wider than the base part 120. The orifice plate 116 has defined in it an array of orifices 118, each orifice being in fluid communication with a firing chamber 140 defined inside the print head, as explained more fully below.

With particular reference to FIGS. 6–9, the recess 112 in the assembly body 80 is constructed to be generally wider than the base part 120 of the print head, except at the ends of the recess 112 where opposing alignment features 122 protrude inwardly toward the longitudinal center line of the recess 112. The distance between the opposing pair of alignment features 122 at each end of the recess substantially matches the width of the print head base part 120. As a result, these features secure the print head with its longitudinal center line matching that of the recess.

The long side edges 124 of the print head base part 120 (see FIG. 9) are spaced from the corresponding long side edges of the recess 112. This spaced relationship, therefore, defines an elongated first ink passageway 126 extending the substantial length of one side of the print head, and a corresponding, second ink passageway 128, extending along the substantial length of the other side of the print head. It will be appreciated that the passageways 126, 128 are enclosed along their substantial length by the print head base part 120, print head body, and the underside of the orifice plate 116 (See FIG. 9).

An inflow channel 130 is formed in the recessed surface 113 to connect the inlet conduit 90 with the inflow or upstream end of the first ink passageway 126. Accordingly, ink flowing into the inlet pipe 86 passes through the inflow channel 130 and first ink passageway 126 as shown by the arrows in FIG. 8.

At the opposite, downstream end of the first ink passageway 126, the ink flows through a cross-channel 134 that is formed in the recessed surface 113 of the pen body 80. The cross-channel delivers the ink to the opposite long side of the recess 112 where ink moves into one end of the second ink passageway 128 and flows along the length of that passageway. The downstream end of the passageway 128 is in fluid communication with an outflow channel 136 that is formed in the recessed surface 113 to provide fluid communication between that passageway 128 and the outlet conduit 92. Accordingly, ink flows through passageway 128, through the outflow channel 136 and into the outlet conduit 92 as shown by arrows in FIG. 8.

Figure 7:
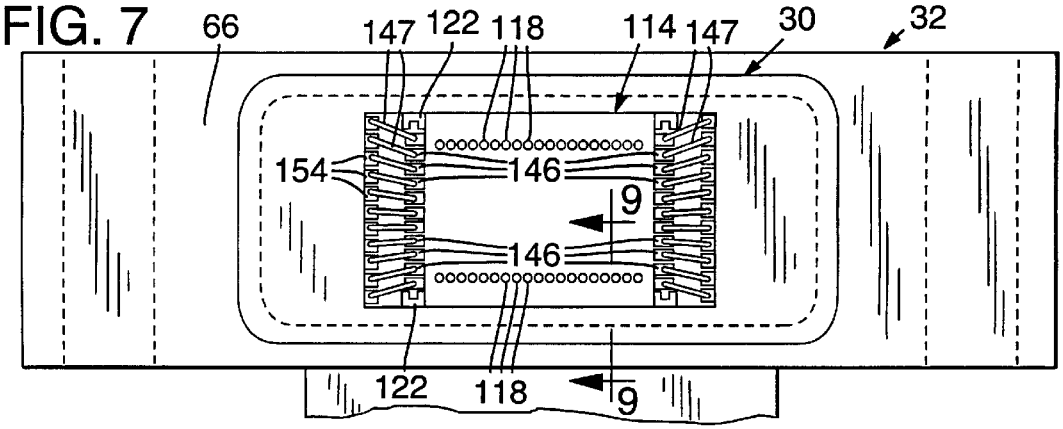
FIG. 7 is a top plan view of the print head assembly mounted to the carriage.
Figure 8:
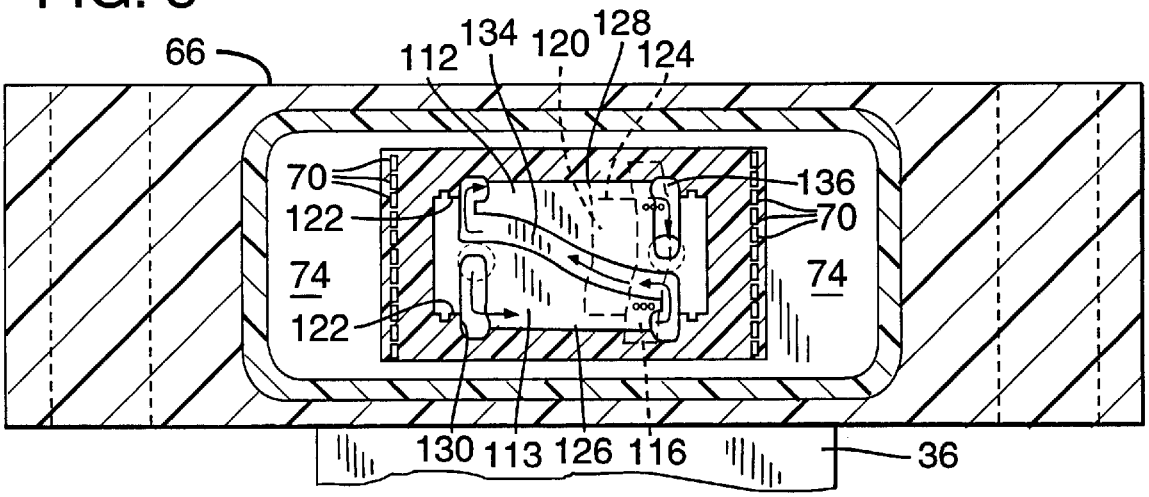
FIG. 8 is a cross-section taken along line 8—8 of FIG. 6.
Figure 9:
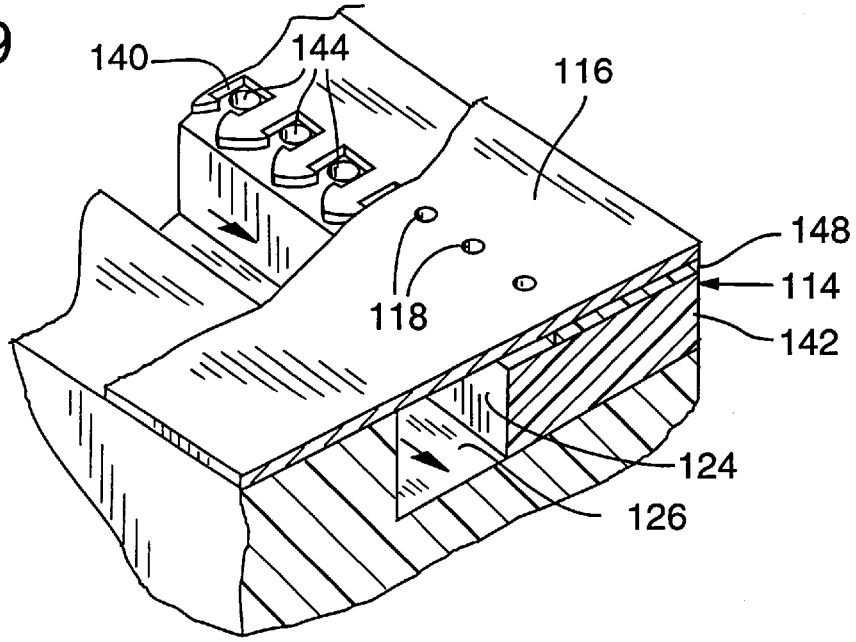
FIG. 9 is an enlarged partial section taken along line 9—9 of FIG. 7.

In view of the above, it will be appreciated that both long sides of the print head 114, at which are defined firing chambers 140 for each orifice 118 (FIG. 9), are supplied with circulating ink. More specifically, FIG. 9 depicts in enlarged detail the relationship between the print head firing chambers 140 and the first ink passageway 126. The print head base part 120 may be constructed to include a substrate layer 142 that carries on it a number of thin film resistors 144, each resistor underlying a corresponding orifice 118 in the orifice plate 116. Each resistor 144 is electrically connected with a discrete, conductive member (not shown). The other ends of each conductive members are exposed at the two short sides of the print head to form arrays of electrical contacts 146 lining the short sides of the print head (FIGS. 6–7). The array of print head contacts 146 are bonded to leads in the print head assembly as described more fully below.

Returning to the print head detail shown in FIG. 9, a thin, barrier layer 148 of polymeric material covers the substrate and is shaped by, for example, a photolithographic process to define the small-volume firing chambers 140 that surround corresponding resistors 144. The outermost edges of the barrier 148 are shaped to define for each chamber 140 an entry gap through which ink may flow into the firing chamber to be heated by the resistor and ejected through a print head orifice 118.

The print head construction is generally symmetrical above the longitudinal center line of the print head 114. Accordingly, it will be appreciated that, although not shown in detail, the relationship of the second ink flow passageway 128, and the print head firing chambers on the opposing sides of the print head provide the same ink supply system as that of the first ink passageway 126.

Although in the foregoing description the print head firing chamber configurations have entrances on the side of the print head, it is contemplated that print heads having firing chamber entrances fed from a channel in the center, underside of the print head may also be employed with the present invention. It will be appreciated by one of ordinary skill that redefining the pen body recess 112 to include passageways in communication with such central firing chambers would be readily accomplished.

As best shown in FIGS. 1 and 6, the leads 70 carried by the print head assembly are arranged so that near the bottom of the print head body 80 a bowed end 152 of each lead is exposed to protrude outwardly toward the end wall 64 of the socket. A bowed end 152 of a print head lead aligns with the exposed bowed end 54 of a carriage lead 50 such that when the print head base 82 is inserted into the socket 40 the leads 50, 70 will contact at their bowed ends. Preferably, the amount of protrusion of the corresponding bowed ends 54, 152 is such that both ends will deform slightly as the print head leads 70 move toward the surface 42 of the recess, and the lead ends 152 will fit slightly beneath and against the bowed ends 54 of the carrier leads, thereby providing a snap-like mechanism for securing the print head assembly 30 in the carriage 32.

In order to facilitate removal of the print head assembly 30 from the carriage 34, a clearance hole 35 is provided in the underside of the carriage to permit the insertion of a tool through the carriage to bear upon the bottom of the print head assembly to force the assembly out of the socket. A new assembly can be inserted into the carriage socket in the event that replacement is necessary. It is noteworthy that the print head assemblies may be fully tested before mounting to the carriage.

The embedded portion of each print head lead 70 extends through the print head assembly and terminates at a flattened end with the remaining flattened ends of the leads 70 aligned to form an array of print head lead ends 154 (FIGS. 6–7) across from both arrays of contacts 146 on the print head. Preferably, the edge of the assembly body 80 on which the array of lead ends 154 reside is recessed slightly so that the elevation of the ends 154 matches that of the print head contacts 146.

Each end of array 154 is connected with a corresponding array of print head contacts 146 by known means, such as by connectors 147 formed by conventional gold-wire bonding techniques or tape automated bonding (TAB), thereby to provide an electrical path between the print head leads and the print head resistors. It is noteworthy here that while a certain number of leads and contacts have been depicted (11 leads and corresponding contacts at each short edge of the print head), more or fewer such leads and contacts can be.employed. With as few as 22 leads, conventional multiplexing techniques may be employed for directing a control signal to any one of, for example, two hundred resistors (hence, orifices).

The electrical contact region at the short edges of the print head is filled with an encapsulant 156, such as UV9000 manufactured by W. R. Grace of Lexington, Mass. Preferably, the encapsulant is applied so that it protrudes only very slightly, if at all, above the upper surface of the orifice plate 116. In FIG. 7, the encapsulant is omitted, for illustrative purposes.

Figure 10:
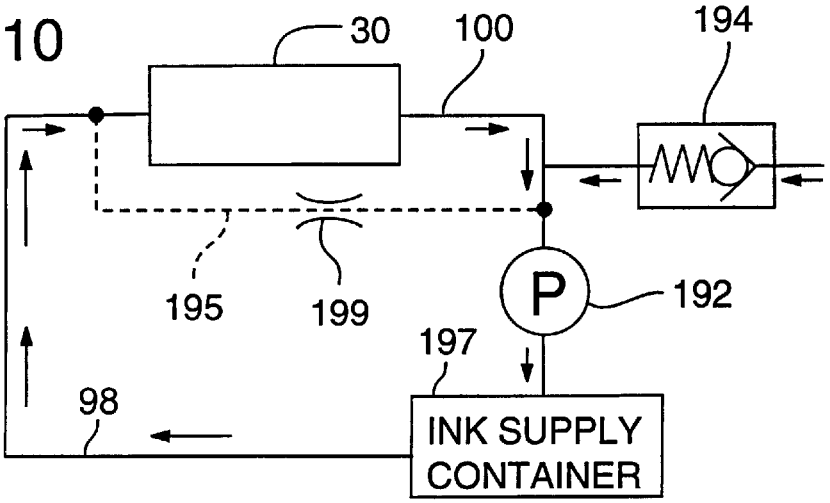
FIG. 10 is a diagram of a circulating ink supply system for the assembly of the present invention.

As noted earlier, the print head assembly may be supplied with ink via inlet tube 98, unused ink returning via outlet tube 100. The diagram of FIG. 10 schematically depicts a system for supplying ink to the print head assembly 30. The system includes an ink supply 197 that comprises any container suitable for storing a supply of ink. The inlet tube 98 extends between the container and the print head assembly and, like the outlet tube 100, is flexible to bend as necessary while the print head assembly 30 is reciprocated by the carriage 32.

An outlet tube 100 is connected to a peristaltic or diaphragm pump 192 that provides the pressure gradient for generating the ink flow through the system. In a preferred embodiment, the fluid pressure within the system is maintained slightly below ambient so that ink will not leak from the print head orifices 118 when the firing chambers 140 are inactive. It is desirable, however, to regulate the pressure within the system so that the partial vacuum or back pressure established in the system does not become so high as to prevent the forces generated in the firing chambers from ejecting ink drops. To this end, a vacuum regulator 194 is connected to the outlet tube 100 (or to any other location in the system) to permit the limited entry of ambient air into the system in the event the pressure within the system drops below a predetermined threshold level. Preferably, the vacuum regulator 194 is adjustable for changing the threshold level as necessary.

If desired, an auxiliary return conduit 195 may be connected between the primary return tube 100 and a location just upstream of the fine-mesh screen 94 on inlet pipe 86. A flow restrictor 199 limits the return flow in conduit 195 so that the conduit 195 removes any air that may be trapped beneath the screen, but does not otherwise divert flow to the print head.

Referring to FIGS. 11–14, a print head assembly 230 depicting an alternative orifice plate 216 and technique for connecting the array of print head lead ends 154 with the print head contact array 146 is now described. More particularly, instead of the earlier described metallic orifice plate 116 and gold-wire bonding technique for connecting the print head contacts and assembly lead ends, the orifice plate 216 of this embodiment is formed of plastic, such as a polyimide, having laser-ablated orifices 218. The remainder of the print head 214 is configured substantially as described earlier, including the base part 120.

The underside 220 of the orifice plate (FIG. 13) has a conductive pattern 266 formed on each end thereof. Each conductive pattern includes an array of connectors comprising an outer contact 270 and an inner contact 272 joined by a conductive trace 274. The inner contacts 272 each align with one of the contacts of the contact array 146 on a print head 214 and are connected thereto by any suitable means, such as by "Z-axis" soldering techniques or conductive adhesives. Each of the outer contacts 270 of the conductive pattern 266 aligns with a corresponding one of the print head lead ends 154 for connection therewith by conventional means, such as by "Z-axis" soldering, paste, wire bonding, adhesives, etc.

The orifice plate 216 of this embodiment is attached directly to the print head body 280. In this regard, the print head body has defined in it a peripheral recess 282 that surrounds the primary recess 276 in which the print head base 120 is located. The edges of the orifice plate 216 extend into the peripheral recess 182. The orifice plate 216 is heat-staked at its edges to the print head body at the peripheral recess 282.

The patterns 266 on the orifice plate surface 220 are preferably surrounded with continuous embossments, depicted as dashed lines 287, that, upon heat-staking, flow to provide a liquid-proof seal around the junction of those patterns and lead ends 154 and contacts 146 so that ink or any other liquid is unable to reach the junction. It can be appreciated, therefore, that the construction just described eliminates the need for an encapsulant.

It is noteworthy that the primary recess 276 in the assembly 230 receives the print head and has, like earlier described embodiments, the underlying channels 130, 134, 136 for directing ink to the print head 214.

Figure 11:
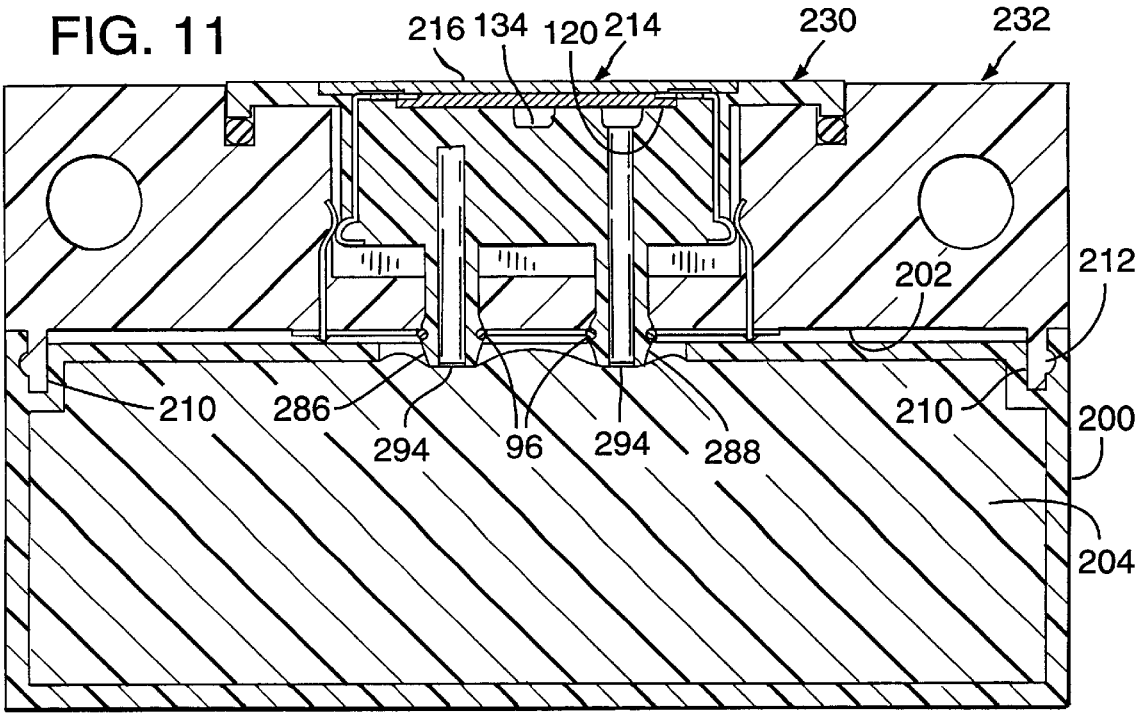
FIG. 11 is a cross-sectional view of an alternative embodiment of a print head assembly, including an alternative ink supply system for the assembly.
Figure 12:
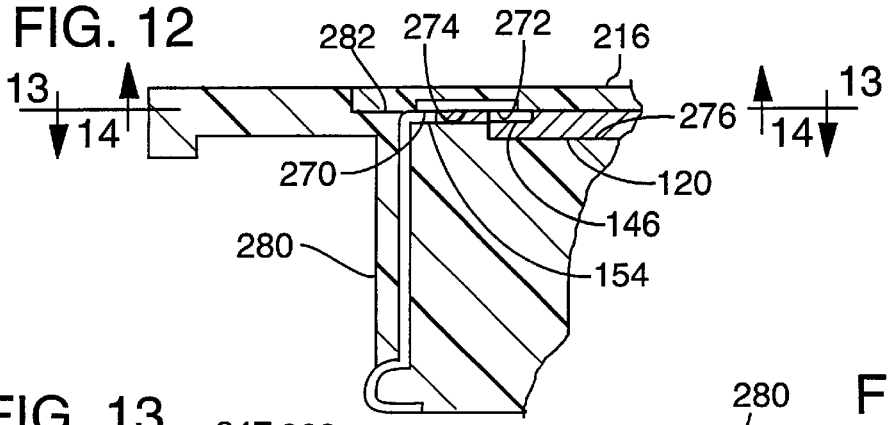
FIG. 12 is an enlarged depiction of a portion of a section view of FIG. 11.
Figure 13:
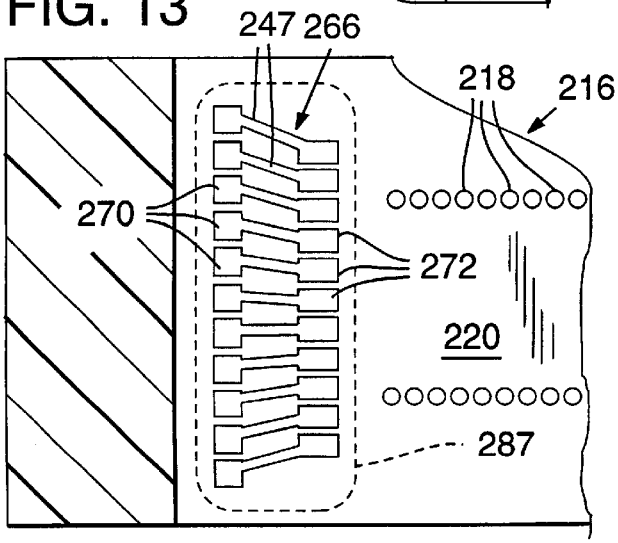
FIG. 13 is a section view taken along line 13—13 of FIG. 12.
Figure 14:
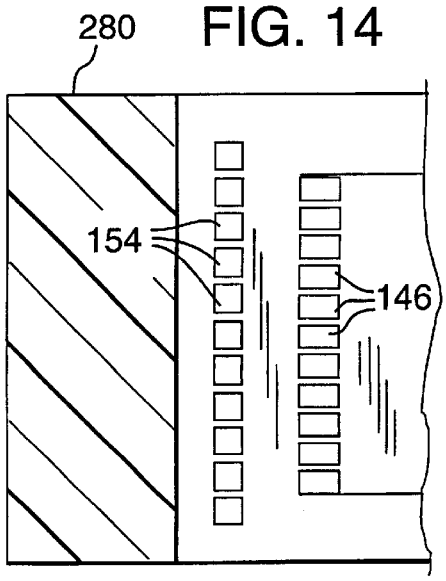
FIG. 14 is a section view taken along line 14—14 of FIG. 12.

FIG. 11 also depicts another alternative mechanism for supplying ink to the print head 214. In this embodiment, no tubes trailing to a remote supply are employed. Instead, a foam-filled container 200 is removably mounted to the underside 202 of the carriage 232 so that the protruding inlet and outlet pipes 286, 288 (similar to the pipes 86, 88 described above) are forced against and compress the foam 204. The foam 204 is saturated with ink, and the average pore size of the foam (about 0.2 mm) provides sufficient capillarity to prevent leakage of ink through the print head when the print head is not operating.

Ink in the foam 204 is able to flow toward the print head 214 through both pipes 286, 288. The ends of both pipes are covered with fine-mesh screens 294 and ink is retained in the print head between the screens and the orifices 218 via capillary forces, even after the foam-filled supply container 200 is removed for replacement.

In this embodiment, both pipes 286, 288 act as inlets for directing ink to the print head. It is pointed out, however, that a single such pipe could be employed. Such a single-pipe embodiment may be used with print heads having either side channels or a central channel for feeding the firing chambers as described above.

Moreover, a single-pipe embodiment as just mentioned could be supplied with ink via a tube, such as inlet tube 98. A supply system such as depicted in FIG. 10 would be adapted for use with this embodiment. In this regard, an outlet tube (as tube 100) would not be present, although a pump (as pump 192) and return conduit (as conduit 195, with restrictor 199) may be connected for the purposes described earlier.

Preferably, the carriage 232 is formed with a downwardly protruding peripheral rib 210 that includes a feature 212 (such as the depicted dimple) to permit interlocking of the carriage 232 with the portion of the reservoir container 200 that fits against the carriage. It will be appreciated that any of a number of mechanisms may be employed for an easily removable, snap-type fit between the reservoir container 200 and the carriage 232.

Although the foregoing invention has been described in connection with preferred and alternative embodiments, it will be appreciated by one of ordinary skill that various modifications and variations may be substituted for the mechanisms and method described here without departing from the invention as defined by the appended claims and their equivalents.

For example, it is contemplated that a carriage assembly 32 could be constructed with multiple sockets, into each of which fits a print head assembly. The number and arrangement of assemblies could be such that the entire width of the paper that moves through the printer is spanned with print heads, thereby eliminating the need for reciprocating the carriage.

The invention claimed is:

1. A pen assembly for an ink-jet printer, comprising:

a carriage member defining a socket therein and having a first set of conductive leads attached thereto, the first set of leads having ends that are exposed to protrude into the socket;

a print head assembly removably mounted to the carriage and carrying an ink-jet print head and a second set of conductive leads connected to the print head, the second set of leads being shaped to define exposed ends, part of the print head assembly fitting into the socket so that the ends of the first set of leads contact the ends of the second set of leads thereby providing conductive paths between the first set of leads and the second set of leads, the ends of the second set of leads protruding outwardly from the print head toward an end wall of the socket assembly so that the ends of the first set of leads obstruct movement of the ends of the second set of leads when the print head assembly is removed from the carriage member, thereby to resist removal of the print head assembly from the carriage member; and an ink supply coupled to the carriage member for supplying ink to the print head.

2. The assembly of claim 1 wherein the ends of the first set of leads and the ends of the second set of leads are bow-shaped and protruding by an amount sufficient for the first set of lead ends to obstruct a line of movement of the second set of lead ends away from the socket so that the contact therebetween resists removal of the assembly from the socket.

3. The assembly of claim 1 including a seal member compressed between the print head assembly and the carriage member for preventing liquid movement therebetween.

4. The assembly of claim 3 wherein the sealing means is an elongated elastomeric member disposed between the print head assembly and the carriage member to surround the socket.

5. The assembly of claim 3 wherein the ink supply includes a contained supply of ink, which container is releasably attached to the carriage member.

6. The assembly of claim 3 wherein the seal member is compressed between the print head assembly and the carriage member when part of the print head assembly fits into the socket so that the ends of the first set of leads contact the ends of the second set of leads, providing conductive paths therebetween.

7. The assembly of claim 1 wherein the ink supply is coupled by a pipe member arranged for conducting ink into the print head assembly, the pipe member protruding from the print head assembly, and wherein the ink supply includes a container of ink-retaining foam, the foam being brought into contact with the protruding pipe member whenever the print head assembly is mounted to the carriage member.

8. The assembly of claim 1, further comprising in the carriage member a clearance hole that opens into the socket to facilitate removal of the print head assembly from the carriage member by the insertion of a tool through the clearance hole.

9. The assembly of claim 1 further comprising a groove recessed within the surface of the carriage member, and a seal member compressed within the groove between the print head assembly and the carriage member.

10. The assembly of claim 1 wherein the ink supply is coupled by a first pipe member arranged for conducting ink into the print head assembly, the first pipe member protruding from the print head assembly and into the socket and a second pipe member arranged for conducting ink that is conducted into the print head assembly back to the ink supply, the second pipe member protruding from the print head assembly and into the socket.

11. The assembly of claim 10 wherein the ink supply includes a first tube connected to the carriage member and into which fits the first protruding pipe member and a second tube connected to the carriage member and into which fits the second protruding pipe member. whenever the print head assembly is mounted to the carriage member.

12. The assembly of claim 8 wherein the ink supply includes circulation means for delivering ink to the print head assembly through the first tube and for returning ink from the print head assembly through the second tube.

13. A pen assembly for an ink-jet printer, comprising:

a carriage member defining a socket therein and having a first set of conductive leads attached thereto, the first set of leads having ends that are exposed to protrude into the socket at opposing outer walls of the socket;

a print head assembly removably mounted to the carriage member and carrying an ink-jet print head and a second set of conductive leads connected to the print head, the second set of leads having ends that are exposed to protrude outwardly toward the opposing outer walls of the socket, part of the print head assembly fitting into the socket so that the ends of the first set of leads contact the ends of the second set of leads thereby providing conductive paths between the first set of leads and the second set of leads; and the ends of the first set of leads and the second set of leads, snapping together so that the ends of the second set of leads fit beneath the ends of the first set of leads whenever the print head assembly is mounted to the carriage member, thereby securing the print head assembly to the carriage member.

14. The assembly of claim 13 wherein the print head that is carried by the print head assembly includes a base part having electrical contacts at one end thereof, and wherein the second set of conductive leads has other ends near the print head, the assembly including connection means for connecting the other ends of the second set of leads and the contacts of the print head.

15. The assembly of claim 14 wherein the print head includes an orifice plate mounted to cover the base part of the print head, and wherein the connection means includes conductive patterns on the orifice plate and arranged for connecting the other ends of the second set of leads and the contacts of the print head.

16. The assembly of claim 13 wherein the first set of leads is also connected to a flexible multi-conductor member that is mounted to the carriage member.

17. A method of mounting a print head to a carriage member so that the print head and carriage member are electrically connected, comprising the steps of:

providing in the carriage member a socket having a first set of conductive leads attached thereto, the first set of leads having ends that are exposed to protrude into the socket;

attaching to the print head a body member that carries a second set of leads that are connected to the print head;

arranging the second set of leads so that ends of the second set of leads are exposed to protrude outwardly from the body member toward an end wall of the socket; and moving the body member into the socket so that the exposed ends of the second set of leads snap-fit beneath the exposed ends of the first set of leads.

18. The method of claim 17 including the step of shaping the exposed first and second sets of lead ends to be bowed, so that the bowed ends of the first set of leads resists removal of the body member from the carriage member.

19. The method of claim 17 further including the steps of:

providing an ink supply coupled to the carriage member;

arranging a pipe member to protrude from the print head assembly and into the socket for conducting ink from the ink supply into the print head;

arranging a tube connected to the carriage member and into which fits the protruding pipe member; and moving the body member into the socket so that the protruding pipe member fits into the tube at the same time that the exposed ends of the second set of leads snap-fit beneath the exposed ends of the first set of leads so that the print head and the carriage member are fluidly connected at the same time the print head and carriage member are electrically connected.

20. The method of claim 17 further including the steps of:

providing an ink supply coupled to the carriage member;

arranging a seal member between the print head and the carriage member; and compressing the seal member between the print head and the carriage member at the same time that the exposed ends of the second set of leads snap-fit beneath the exposed ends of the first set of leads so that liquid movement between the print head and the carriage member is prevented at the same time the print head and carriage member are electrically connected.

* * * * *